US006475426B1

(12) United States Patent
Desai et al.

(10) Patent No.: US 6,475,426 B1
(45) Date of Patent: Nov. 5, 2002

(54) RESIN-BONDED LINER

(75) Inventors: Priyadarshi G. Desai, Allegheny County, PA (US); Johan L. Richaud, Allegheny County, PA (US); Duane L. DeBastiani, Allegheny County, PA (US)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/818,219

(22) Filed: Mar. 27, 2001

(51) Int. Cl.[7] ..... C21B 7/04

(52) U.S. Cl. ..... 266/280; 266/286; 222/606; 501/99; 501/128

(58) Field of Search ..... 266/236, 280, 266/286; 222/606; 501/99, 108, 128

(56) References Cited

U.S. PATENT DOCUMENTS

| | | | | |
|---|---|---|---|---|
| 4,836,508 A | | 6/1989 | Fishler | |
| 4,870,037 A | | 9/1989 | Hoggard et al. | |
| 4,871,698 A | | 10/1989 | Fishler et al. | |
| 5,185,300 A | | 2/1993 | Hoggard et al. | |
| 5,286,685 A | | 2/1994 | Schoennahl et al. | |
| 5,691,061 A | | 11/1997 | Hanse et al. | |
| 5,885,520 A | * | 3/1999 | Hoover | 222/606 |
| 6,103,651 A | * | 8/2000 | Leitzel | 501/128 |

FOREIGN PATENT DOCUMENTS

| | | |
|---|---|---|
| EP | 0669293 A1 | 8/1995 |
| GB | 2111880 A | 7/1983 |
| GB | 2135918 A | 9/1984 |
| GB | 2170131 A | 7/1986 |

* cited by examiner

*Primary Examiner*—Scott Kastler
(74) *Attorney, Agent, or Firm*—James R. Williams

(57) ABSTRACT

In the continuous casting of molten metal, the invention describes a refractory article for reducing deposition of inclusions on a surface contacting the stream of molten metal. The article comprises a first composition and a second composition on at least a portion of the contacting surface. The second composition includes a resin-bonded refractory composition comprising a refractory aggregate and a reactive metal. The resin-bonded refractory composition reduces deposition of inclusions relative to standard carbon-bonded or castable refractories. The second composition is particularly effective as a nose of a stopper rod or a liner for a nozzle, shroud or slide gate plate.

14 Claims, 1 Drawing Sheet

RESIN-BONDED LINER

FIELD OF THE INVENTION

The present invention relates to refractory articles that are used in the casting of steel, and particularly to such articles that are resistant to deposition onto the article's walls of inclusions such as, for example, alumina and titania.

DESCRIPTION OF THE RELATED ART

In the continuous casting of steel, refractory articles permit the transfer of molten steel between various containers, notably between the ladle and the distributor, and the distributor and the continuous casting mold. Such articles include, but are not limited to, stopper rods, shrouds, nozzles, and slide gate plates.

Refractory articles direct the flow of molten steel but also protect the steel from oxygen, which can reduce the quality of the steel. Despite these precautions, considerable amounts of oxygen can still dissolve in and react with the molten metal. Dissolved oxygen can precipitate from the steel and react with carbon to produce carbon monoxide. These gases create undesirable porosity, cracks and internal defects, which lower the quality of the finished steel. To eliminate dissolved oxygen, molten steel is often "killed," for example, by the addition of aluminum metal. In aluminum-killed steels, aluminum metal reacts with dissolved oxygen or iron oxide to form finely dispersed alumina, some of which floats into the slag above the molten metal and some of which remains as dispersed particles in the molten metal and the solidified steel.

These finely dispersed alumina particles have an affinity for carbon-bonded refractory materials, especially those containing graphite, which are commonly used in the continuous casting of steel. During casting, finely dispersed alumina may precipitate out of the molten metal onto the refractory surfaces. Alternatively, alumina may chemically react with and stick to the refractory surfaces. Accumulation of alumina on a nose of a stopper rod can prevent positive shut-off of the molten metal stream. Deposition in the casting channel of a nozzle, shroud or slide gate plate can clog the casting channel and substantially reduce the flow of molten steel.

Articles may be unclogged using an oxygen lance; however, lancing disrupts the casting process, reduces refractory life, and decreases casting efficiency and the quality of the steel produced. A total blockage of the casting channel by alumina decreases the expected life of the article and is very costly and time-consuming to steel producers. For example, steel having an initially high dissolved oxygen content can limit a shroud to 2–3 ladles due to heavy alumina buildup in the casting channel.

A common industrial technique to reduce alumina deposition is the injection of an inert gas, such as argon. The inert gas forms a protective barrier, and inhibits the finely dispersed alumina from precipitation on and reaction with graphite-containing refractories. The inert gas also reduces the partial pressure of oxygen around the molten metal farther decreasing formation and deposition of alumina. Exemplary of inert gas injection is UK patent application GB 2,111,880 A to Gruner et al. and U.S. Pat. No. 4,836,508 to Fishler, which describe a pour tube having a gas permeable refractory surrounding the casting channel. Unfortunately, gas injection requires large volumes of inert gas, complicated refractory designs, and is not always an effective solution. Inert gas at high pressure may also dissolve into the molten metal causing pinhole defects in the steel. Instead of, or in combination with, inert gas injection, a second refractory composition may be placed on refractory surfaces that are exposed to a stream of molten metal. For example, a surface composition may cover the nose of a stopper rod or the casting channel of a pour tube. The surface composition may be a lower melting point refractory, which sloughs off as alumina deposits on the surface. Such compositions include CaO—MgO—$Al_2O_3$ eutectics, as described in UK patent application GB 2,170,131 to Tate, or MgO according to UK patent application GB 2,135,918 to Rosenstock. These compositions tend to hydrate and are used up during casting. Their high thermal expansion coefficients can also cause surface cracking. For these reasons, the useful life of the surface layer is limited. To extend the life of the layer, refractory articles having compositions containing calcium oxide or calcium zirconate have been used. These compositions attempt to continuously replace CaO eutectics on the surface. Unfortunately, CaO does not diffuse to the surface quickly enough to be completely effective.

Other surface compositions, which inhibit alumina deposition, include SiAlON-graphite refractories as taught in U.S. Pat. No. 4,870,037 to Hoggard et al. and U.S. Pat. No. 4,871,698 to Fishler et al. SiAlON comprises a solid solution and/or dispersion of aluminum oxide and aluminum nitride in a silicon nitride matrix, and is believed to reduce wetting by molten metal. Graphite has superior thermal shock-resistance, and is often a major component in stopper rods, nozzles, shrouds and slide gate plates. Despite these benefits, SiAlON-graphite refractories are expensive, and graphite makes the composition susceptible to oxidation. Oxidation of the graphite accelerates alumina deposition and erosion of the refractory. To reduce oxidation, U.S. Pat. No. 5,185,300 to Hoggard et al. teaches metal diborides as sacrificial oxygen getters.

U.S. Pat. No. 5,691,061 to Hanse et al. teaches carbon-free surface compositions produced by the controlled oxidation of a carbon-containing material. The patent claims an initial composition of a metal oxide, carbon and a sintering precursor, and describes heating the composition, preferably above 1000° C., in an oxidizing atmosphere leaving a densified, carbon-free, gas-impermeable material, which is resistant to alumina deposition. In practice, oxidation of the carbon is typically performed during preheating. Preheating is a common technique to raise the temperature of a refractory article before actual use, thereby reducing thermal shock to the article when contacting molten metal. Although eliminating problems associated with carbon oxidation, the preheating regime necessary to burn off the carbon and effect the required compositional changes is not always practical.

U.S. Pat. No. 5,286,685 to Schoennahl et al. describes a refractory composition, comprising a high melting point refractory, such as alumina, magnesia or MgO—$Al_2O_3$ spinel, aluminum nitride (AlN), and boron nitride. AlN is the bonding phase and, therefore, is said to avoid problems associated with carbon oxidation in carbon-bonded refractories. AlN-bonded refractories are purportedly resistant to alumina deposition, oxidation, erosion, do not promote reactions associated with alumina deposition, are resistant to thermal shock, and are not readily wetted by molten steel. AlN bonding occurs by shaping a piece comprising powdered aluminum metal and firing the piece in situ under a nitrogen atmosphere. This process is both dangerous, due to the presence of a reactive metal powder, expensive, and time consuming.

A need persists for an inexpensive, easily fabricated refractory composition that inhibits alumina deposition while resisting oxidation and erosion. Such a composition would be especially useful as a surface layer exposed to a stream of molten metal, for example, a stopper rod nose or a liner in the casting channel of a refractory nozzle, pour tube or slide gate plate.

SUMMARY OF THE INVENTION

The present invention describes a refractory article for use in the casting of molten steel that reduces the accumulation of inclusions, particularly alumina, on surfaces exposed to a stream of molten steel. The surface may be, for example, a nose of a stopper rod or a liner in a shroud, nozzle or slide gate plate.

In a broad aspect, the article comprises a first refractory composition forming the bulk of the article and a second refractory composition defining the contact surface. The first composition may be any number of refractory materials, such as carbon-bonded, oxide-bonded and castable materials. The second refractory composition is formed from a mixture including a refractory aggregate, a binder and a reactive metal. The mixture is cured below about 200° C. to form a resin-bonded composition. After curing, the resin-bonded composition is preferably heat-treated below about 800° C.

The second refractory composition is described as a cured, resin-bonded material in contrast to materials that are fired, carbon-bonded, oxide-bonded or comprise refractory cement. In one embodiment, the second composition comprises 50–90 wt. % refractory aggregate, 1–10 wt. % binder, and 0.5–15 wt. % reactive metal. A second composition may also include carbon, carbides and boron compounds. In another embodiment, the cured article includes 65–80 wt. % fused alumina, 2–30 wt. % calcined alumina, 0.5–10 wt. % aluminum metal, up to 15 wt. % zirconia and less than 1 wt. % silica. As a low temperature-treated material, the second refractory composition retains the reactive metal in a substantially unreacted state before preheating or casting operations.

Another aspect of the invention describes the first refractory composition as a fired material that is copressed with the second refractory composition. Another aspect teaches a first refractory composition that is cast around a pressed piece comprising the second refractory material.

DETAILED DESCRIPTION OF THE PREFERRED EMBODIMENTS

Figure 1:
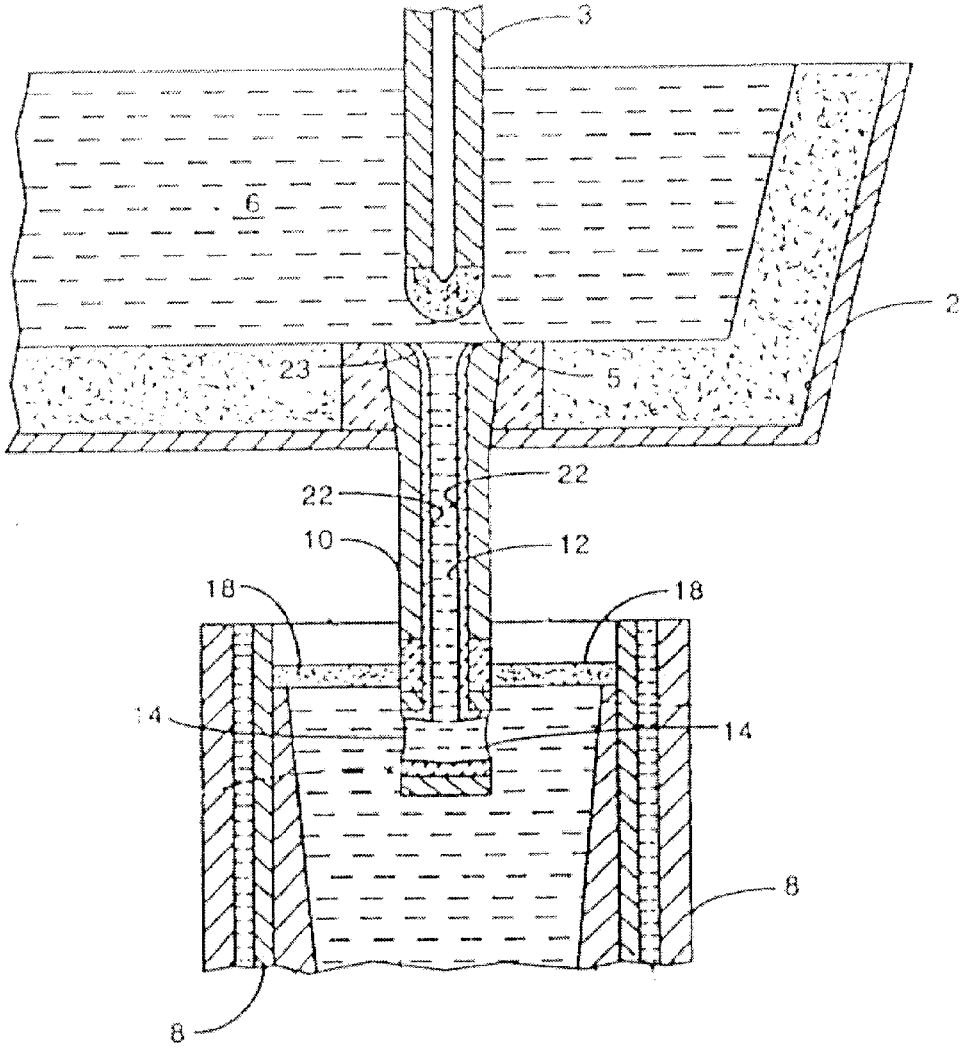
FIG. 1 shows a cross-section of a steel caster, including a tundish, stopper rod, sub-entry nozzle and mold.

A refractory article for use in the casting of molten steel comprises a refractory piece including a first refractory composition and a second refractory composition covering, at least in part, a surface that is exposed to a stream of molten steel. The article may be, for example, a stopper rod, nozzle, including well nozzle, shroud, or slide gate plate, or combinations thereof. The second composition should be more resistant than the first composition to oxygen ingress/diffusion during the continuous casting of steels. Oxygen ingress/diffusion is probably related to deposition of inclusions, particularly alumina, on surfaces that contact the stream of molten metal. The second refractory composition may be used on any surface to inhibit deposition from molten steel.

FIG. 1 shows a cross-section of a typical apparatus for use in the continuous casting of steel. A tundish 2 contains molten metal 6 that streams through a casting channel 12 of a nozzle 10 into a continuous casting mold 8. In the drawing, the nozzle 10 is depicted as a submerged-entry nozzle having exit ports 14 below the slag surface 18. The stream of molten metal may be regulated by a stopper rod 3 having a nose 5 that can cooperatively and sealingly engage a seat 23 of the nozzle 10 in a bottom orifice 7 of the tundish 2. When the nose 5 is lowered against the seat 23, the bottom orifice 7 is closed and the flow of molten metal from the tundish 2 to the mold 8 is stopped.

Alternatively, a slide gate mechanism (not shown) may be used in place of the stopper rod to shut off the stream of molten metal. Such a mechanism contains a plurality of refractory plates with each plate having at least one casting channel that, when aligned with the casting channel(s) on the other plate(s), permits flow of the molten metal. A tundish well nozzle and a submerged entry shroud are often used in conjunction with a slide gate mechanism. The invention is also applicable in refractories used in transferring molten steel between a ladle and a tundish.

The first refractory composition may comprise any suitable refractory material. Desirable, but not necessary, features of the first material include easy grindability, high permeability and low thermal conductivity compared to the second composition. Grindability permits easier machining of a refractory article to its finished dimension. Permeability allows the injection of inert gas into the article. Low conductivity insulates the molten steel and reduces the likelihood of steel freezing in the nozzle.

The first refractory composition often comprises carbon-bonded refractories and castable materials; although, oxide-bonded refractories are also possible. Carbon-bonded refractories include mixtures of refractory aggregate, graphite and a binder that have been fired under reducing conditions. Firing means heating the composition at a temperature capable of forming metal carbides, particularly aluminum carbide. Such temperatures are typically above 800° C., but may be higher depending on the firing time. Refractory aggregate includes any refractory material suitable for steel casting, including but not limited to alumina, magnesia, calcia, zirconia, silica, compounds and mixtures thereof. Conveniently, the first refractory composition may comprise a castable material that can be molded around or within the second refractory material. A castable material includes any of the refractory cement-like products commonly used in the industry.

The second refractory composition includes a resin-bonded material that is resistant to alumina deposition. The resin-bonded material includes at least one refractory aggregate, a curable resin binder and a reactive metal. The curable resin binder should be cured but should not be fired. Typically, the binder is organic and usually the binder is a carbon resin, such as, a carbonaceous binder derived from pitch or resin. The binder may include other types of organic binders, such as, phenolic compounds, starch, or lignosulfinate. Binder must be present in an amount for adequate green strength in the unfired piece after curing. Curing commonly occurs at below around 300° C. Heat treatment comprises heating the piece below firing temperatures, preferably below about 800° C. and most preferably below about 500° C. The amount of binder will vary depending on, for example, the type of binder used and the desired green strength. A sufficient amount of binder will typically be from 1–10 wt. %.

Reactive metal includes aluminum, magnesium, silicon, titanium, and mixtures and alloys thereof. Conveniently, reactive metals are added as powders, flakes and the like. The reactive metal should be present in sufficient quantity so that, during casting of molten steel, the reactive metal scavenges any oxygen that may diffuse into or emanate from the refractory article. Oxygen is thereby restricted from contact or reaction with the molten steel or other refractory components. Various factors affect the amount of reactive metal that will be sufficient to scavenge oxygen. For example, the inclusion of oxygen-releasing compounds, such as silica, require higher levels of reactive metal in order to scavenge the released oxygen. Obviously, shrouding the resin-bonded material with inert gas will reduce the amount of oxygen reaching the resin-bonded material and, therefore, the required amount of reactive metal will decrease. Limitations on the amount of reactive metal include cost and hazardousness. Reactive metals are generally more expensive than refractory aggregates and, especially as powders, reactive metals can be explosive during processing. A typical amount of reactive metal is from 0.5–10 wt. %.

Importantly, the second refractory material is cured and is not fired until use. Use includes preheating or casting operations. Firing tends to destroy the resin binder and reactive metal components. During firing, the binder can oxidize, thereby reducing the physical integrity of the article, and the reactive metal can form undesirable compounds. For example, aluminum metal can react to form aluminum carbide under reducing conditions or aluminum oxide under standard atmosphere. An article comprising aluminum carbide is susceptible to hydration and destructive expansion. Aluminum oxide does not inhibit and may actually accelerate alumina deposition. In either case, the beneficial effect of aluminum metal is lost.

The second refractory composition may also include carbon, stable carbides, borates and antioxidants. Carbon is often added as graphite to reduce thermal shock and wettability by the steel. Carbon can be present in an amount up to 30 wt. %, but preferably less than about 15 wt. % is present. Stable carbides include carbides that do not form unstable oxides, oxides having a low vapor pressure, or oxides that are not reduced by alumina, titania or other rare earth oxides that are used in steel treatment such as, for example, cerium and lanthanum. Examples of stable carbides include aluminum carbide, titanium carbide, and zirconium carbide. Care should be taken to ensure that the carbide does not hydrate before use. Carbides can cause cracking in the article during preheating.

Antioxidants include any refractory compound that preferentially reacts with oxygen, thereby making the oxygen unavailable to the molten steel. Boron compounds are particularly effective and include elemental boron, boron oxide, boron nitride, boron carbide, borax and mixtures thereof. Boron compounds act as both a flux and an antioxidant. As a flux, boron compounds reduce porosity and permeability, thereby creating a physical barrier to oxygen diffusion and ingress. As an antioxidant, boron compounds scavenge free oxygen making it unavailable to the steel. Like reactive metals, firing destroys antioxidants while curing preserves their utility. The effective amount of antioxidant will vary depending on the one selected. An effective amount of boron compounds is typically from 0.5–7 wt. %.

In an article of the present invention, the first refractory composition makes up the body of the article, and the second refractory composition covers at least a portion of the surface exposed to the flow of molten metal. For example, the second composition may comprise at least a portion of a liner 22 on an interior surface of the casting channel 12 of a nozzle 10, or a portion of the nose 5 of a stopper rod 3. Preferably, the second composition will include the entire surface of a casting channel and/or the seating area of the stopper nose.

The first and second compositions are joined to form a single refractory article. For example, the compositions may be co-pressed; one composition may be formed around or within the other composition; or pieces comprising first and second compositions may be joined together, such as by mortaring. Co-pressing is useful when the first and second compositions are particulates, and is particularly useful when the compositions require similar processing, such as, curing cycles. Pressing includes isostatic and standard pressing. Co-pressing is still also possible when one composition is pressed with a perform piece of the other composition. For example, a first composition may be pressed and fired to form a carbon-bonded perform. A second composition can then be pressed with the fired first composition, and the second composition can be cured to form the refractory article.

Alternatively, a second material may be pressed and a first material may be molded in or cast around the second material. In one such embodiment, a slide gate plate may have a liner comprising the second material and a castable material may comprise the remainder of the plate. Castable material is often cured for several hours or days under high humidity conditions. Another method of combining first and second compositions includes joining a first piece comprising a fired, first composition to a second piece comprising a cured, second composition. Typically, a refractory mortar is used to join the two pieces.

Prior art describes resin-bonded compositions but does not identify the resistance of such compositions to alumina deposition. For example, EP 0 669 293 recognizes the oxidation resistance of a resin-bonded composition, but does not describe resistance to alumina deposition. Resin-bonded compositions can also be more susceptible to cracking caused by thermal shock than carbon-bonded or cast materials. A refractory article should not consist essentially of a resin-bonded composition because such an article could have a tendency to crack because of thermal effects during preheating and casting operations. The severity of cracking ranges from problematic for tundish well nozzles to catastrophic for submerged entry nozzles and shrouds. To overcome this deficiency, the present invention combines a resin-bonded refractory with a first composition.

To control thermally induced cracking, the proportion of resin-bonded refractory relative to the first composition should be controlled. The proportion of resin-bonded refractory depends on several factors, including the compositions of the refractory compositions, the use of the refractory article and the article's geometry. In one example, a nozzle comprises a liner of second material forming a casting channel. The liner is surrounded by an outer body of first material. The casting channel has a radius, R; the liner has a radial thickness of $(R_1-R)$; and the outer body has a radial thickness of $(R_2-R_1)$. The cross-sectional surface area of the liner relative to the outer body is, therefore, represented by a design ratio:

$$(R_1^2-R^2)/(R_2^2-R^2).$$

A similar design ratio is deducible where the second material surrounds the first material. In a submerged entry nozzle, a design ratio of up to sixty percent can have sufficient thermal shock-resistance. A tundish well nozzle does not require as good thermal shock resistance, so the design ratio may be as high as eighty percent.

Preferably, the thermal expansion coefficients of the first and second refractory compositions will be similar enough to reduce or eliminate serious thermal stresses between the two materials. For example, a first refractory material comprising alumina suggests the use of a second refractory material comprising alumina. Judicious selection promotes adhesion between the two refractory compositions, and reduces surface and/or interfacial cracking.

EXAMPLE 1

Mixes were made having the compositions listed in Table 1. Each mix was pressed into a flat piece and cured at a temperature below 500° C. Mixes B–D were additionally fired in a reducing atmosphere at a temperature above 800° C. The pieces were cut into rectangular samples. Mix A represents a variety of resin-bonded compositions according to the present invention. Mix B was a standard carbon-bonded alumina-graphite, which is commonly used for the body of pour tubes. Mixes C and D were fired compositions identified as reducing alumina buildup.

The four samples were immersed in a molten, aggressive, aluminum-killed steel. At a predetermined time, the samples were removed from the steel. Compositions of Mix A had little or no alumina buildup. Mix B had developed a thick deposit of alumina. Mixes C and D showed moderate amounts of alumina buildup.

TABLE 1

| | Mix A | Mix B | Mix C | Mix D |
|---|---|---|---|---|
| Refractory Aggregate, wt. % | 80–93 | 73 | 86 | 69 |
| Graphite, wt. % | up to 7.5 | 18 | 4 | 22 |
| Resin Binder, wt. % | 2.5–4.0 | 7.5 | 4 | 9 |
| Reactive Metal, wt. % | 4.0–7.0 | 1.5 | 6 | 0 |
| Alumina Buildup, mm | 0.3 | 3.0 | 2.0 | 2.0 |

EXAMPLE 2

A first tundish inner nozzle was made comprising a standard refractory composition. A second tundish inner nozzle was made having a casting channel comprising Mix A. Both nozzles were used to cast aluminum-killed steel. At the end of the casting campaign, the nozzles were removed and "pins" from each nozzle were inspected. A "pin" is a quantity of steel that has solidified in the casting channel after the gate is closed. The pin from the first nozzle included substantial alumina buildup along the casting channel. No alumina buildup was observed in the pin from the second nozzle, which comprised the present invention.

Obviously, numerous modifications and variations of the present invention are possible. It is, therefore, to be understood that within the scope of the following claims, the invention may be practiced otherwise than as specifically described.

We claim:

1. A refractory article for use in the casting of molten metal comprising a first refractory composition comprising a non-resin bonded material and a contacting surface adapted to contact a stream of molten metal, at least a portion of the contacting surface comprising a second refractory composition formed from a resin bonded refractory mixture comprising at least one refractory aggregate, a curable resin binder and a reactive metal selected from the group consisting of aluminum, magnesium, silicon, titanium, and mixtures and alloys thereof, wherein the article has a design ratio of less than eighty percent.

2. The refractory article of claim 1, wherein the article is selected from the group consisting of a stopper rod, a nozzle, a shroud, a slide gate plate, and combinations thereof.

3. The refractory article of claim 1, wherein the article includes an inner surface defining a casting channel and the contacting surface comprises at least a portion of the casting channel.

4. The refractory article of claim 1, wherein the contacting surface comprises at least a portion of a nose of a stopper rod.

5. The refractory article of claim 1, wherein the first refractory composition is selected from the group consisting of a carbon-bonded refractory, an oxide-bonded refractory and a castable material.

6. The refractory article of claim 1, wherein the resin-bonded refractory mixture comprises 50–90 wt. % refractory aggregate, 1–10 wt. % binder and 0.5–15 wt. % reactive metal.

7. The refractory article of claim 1, wherein the refractory aggregate comprises at least one refractory material selected from the group consisting of alumina, zirconia, calcia, magnesia, silica, and mixtures and compounds thereof.

8. The refractory article of claim 1, wherein the resin-bonded refractory mixture comprises a boron compound selected from the group consisting of elemental boron, boron oxide, boron nitride, boron carbide, metallic borides and mixtures thereof.

9. The refractory article of claim 1, wherein the resin-bonded refractory mixture comprises a stable carbide.

10. The refractory article of claim 9, wherein the stable carbide is selected from the group consisting of aluminum carbide, titanium carbide, and zirconium carbide.

11. A refractory article for use in the casting of molten metal comprising a first refractory composition comprising a non-resin bonded material and a contacting surface adapted to contact a stream of molten metal, at least a portion of the contacting surface comprising a resin-bonded second refractory composition comprising at least one refractory aggregate and a reactive metal present in sufficient quantity to scavenge oxygen during casting of molten metal.

12. The refractory article of claim 11, wherein the reactive metal comprises at least one metal selected from the group consisting of aluminum, magnesium, silicon, titanium, and mixtures and alloys thereof.

13. The refractory article of claim 11, wherein the second refractory composition comprises up to 0.5–15 wt. % reactive metal.

14. The refractory article of claim 11, wherein the second refractory composition is made from a mixture comprising 65–80 wt. % fused alumina, 2–30 wt. % calcined alumina, 1–10 wt. % binder, 0.5–10 wt. % aluminum metal, up to 15 wt. % zirconia and less than 3 wt. % silica.

* * * * *